US006633727B2

(12) United States Patent
Henrie et al.

(10) Patent No.: US 6,633,727 B2
(45) Date of Patent: Oct. 14, 2003

(54) INTEGRATED HEATER AND CONTROLLER ASSEMBLY

(75) Inventors: John Henrie, Ogden, UT (US); Myron L. Jensen, Harrisville, UT (US); Steve U. Nestel, Ogden, UT (US); Randy C. Jarrett, Mantua, UT (US); Lorin T. Adkins, North Ogden, UT (US)

(73) Assignee: Chromalox, Inc., Pittsburgh, PA (US)

( * ) Notice: Subject to any disclaimer, the term of this patent is extended or adjusted under 35 U.S.C. 154(b) by 114 days.

(21) Appl. No.: 09/850,700

(22) Filed: May 8, 2001

(65) Prior Publication Data

US 2002/0127007 A1 Sep. 12, 2002

Related U.S. Application Data

(63) Continuation-in-part of application No. 09/782,264, filed on Feb. 13, 2001, and a continuation-in-part of application No. 09/753,872, filed on Jan. 3, 2001.

(51) Int. Cl.[7] ..... H05B 11/02
(52) U.S. Cl. ..... 392/498; 392/497; 392/501
(58) Field of Search ..... 392/497, 498, 392/499, 500, 507

(56) References Cited

U.S. PATENT DOCUMENTS 3,213,263 A * 10/1965 Steenbergen ..... 219/205
3,319,049 A * 5/1967 Ulanet ..... 219/523
3,446,940 A * 5/1969 Morgan ..... 392/455
5,191,634 A * 3/1993 Couch ..... 392/501
6,069,998 A 5/2000 Barnes et al. ..... 392/498
6,137,955 A 10/2000 Krell et al. ..... 392/454

FOREIGN PATENT DOCUMENTS

AU 199910024 A1 1/1999
AU 199914273 A1 2/1999
AU 199932254 A1 5/1999

* cited by examiner

*Primary Examiner*—Thor Campbell
(74) *Attorney, Agent, or Firm*—Kirkpatrick & Lockhart LLP

(57) ABSTRACT

An integrated heater and controller assembly for monitoring and controlling the heating of a process in a reservoir is disclosed. The assembly includes a heater, a coupling adapter, a control unit, and a temperature sensor. The heater attaches to the reservoir and has a heating element extending into the process. The coupling adapter includes a first tubular portion and a second tubular portion. The first tubular portion attaches to the heater. The second tubular portion attaches to the control unit. The first tubular portion is rotatably attached to the second tubular portion. Wires from the control unit communicate through a pathway in the first and second tubular portions and connect to the heater. The control unit has control circuitry to control the power supplied through the wires to the heater. The heater may also have a thermowell that extends into the process. A thermowell adapter may be used to mount the temperature sensor inside the thermowell to measure and report the temperature of the process to the control unit.

33 Claims, 7 Drawing Sheets

INTEGRATED HEATER AND CONTROLLER ASSEMBLY

The present application is a continuation-in-part application and claims priority from co-pending, commonly assigned, application Ser. No. 09/782,264 entitled "Universal Thermowell Adapter Assembly" filed Feb. 13, 2001 and from application Ser. No. 09/753,872 entitled "Adapter Assembly for Heaters and the Like" filed Jan. 3, 2001, the specifications of which are incorporated herein by reference in their entirety.

FIELD OF THE INVENTION

The present invention relates generally to an integrated heater and controller assembly and, more particularly to an assembly for monitoring and controlling the heating of a process having a heater coupled to a control unit using adapter assemblies.

BACKGROUND OF THE INVENTION

The heating and temperature monitoring of tanks and reservoirs is a common industrial practice that has many applications. Heating may be required to maintain a certain viscosity of heavy oils or resins that allow them to be readily pumped. Heating may also prevent crystalline precipitation or freezing during a process, or may simply facilitate the process itself.

An immersion heater represents one type of heater used to heat fluids in a reservoir. The immersion heater, such as a screw plug or flanged heater, has an extending heating element that is inserted through a bore in the reservoir wall, and the base of the heater is mounted within the bore. In this way, the heating elements extend within the reservoir; the base seals the opening; and the electrical terminals for the heating elements lie outside the reservoir wall.

In order to control and monitor the heating of the fluid, a controller is used. The controller regulates power to the heating element. It is particularly advantageous to attach the controller near the reservoir, and even more suitable to couple the controller directly on the portion of the heater outside the reservoir. Several difficulties exist in the art for directly attaching the controller to the heater. Attaching the controller may be hindered by its location on the reservoir or the presence of obstacles near the reservoir. Moreover, the controller for a given application may need to be oriented to allow easy access to the controls by an operator. Existing techniques for attaching the controller to a heater also require cumbersome implementation and a number of components. This makes it more difficult to replace the controller if it fails.

In order to control and monitor the heating of the fluid, a temperature sensor may also be coupled to the controller and placed in thermal communication with the fluid. The temperature sensor may be a mechanical bulb, capillary type sensor, an RTD or a thermocouple. Installing the temperature sensor presents its own complications. In particular, if the temperature sensor is used to monitor the temperature of a corrosive solution or a moving fluid, the sensor may be inserted into a thermowell for protection. A thermowell is a tube that extends through the reservoir wall or the base of the immersion heater. The end of the tube located inside the reservoir is closed to protect the sensor from the corrosive solution or moving fluid. The opposite end of the thermowell (outside the reservoir or heater base) is open. A bulb and capillary type sensor may be press fit into the thermowell. Other types of temperature sensors, such as thermocouples and RTD probes, require adapter assemblies. Of the sensing methods, the electronic monitoring and control using an RTD, a thermocouple or other electronic-monitoring sensors is a more preferable method. This method offers more accuracy and reliability, among other advantages.

The present invention is directed to overcoming, or at least reducing the effects of, one or more of the problems set forth above.

SUMMARY OF THE INVENTION

To that end, the present invention includes an assembly for monitoring and controlling the heating of a process in a reservoir. The assembly includes a heater, a coupling adapter, a control unit, and a temperature sensor. The coupling adapter rotatably attaches the heater to the control unit and includes a first tubular portion and a second tubular portion. The first tubular portion attaches to the heater and the second tubular portion attaches to the control unit. The control unit has wires that communicate through a pathway in the first and second tubular portions and are electrically connected to the heater. The temperature sensor measures a temperature of the process and provides the temperature to the control unit.

In one embodiment, the second tubular portion of the coupling adapter has a slot and the first tubular portion of the coupling adapter has a plurality of screw holes that circumscribe the outer surface of the first tubular portion. The first tubular portion is capable of being slidably retained in the second tubular portion. A locking bolt may be inserted through the slot and into one of the plurality of screw holes to hold the second tubular portion to the first tubular portion. An equivalent embodiment exists having the reverse attachments. Specifically, the second tubular portion is capable of being slidably retained in the first tubular portion.

The control unit has a housing, a control panel, and control circuitry. The control panel is readily accessible to an operator when the control unit is oriented relative to the heater. The control circuitry receives the measured temperature of the process from the temperature sensor and controls the power supplied to the heater.

The heater may have a thermowell that extends into the process. A thermowell adapter may be used to mount the temperature sensor to the thermowell. In one embodiment, the thermowell adapter includes a bayonet adapter, a compression fitting, and a bayonet cap. The compression fitting attaches to the bayonet adapter and installs into an open end of the thermowell. The bayonet cap attaches to the bayonet adapter. The temperature sensor passes through the bayonet cap, the bayonet adapter and the compression fitting and into the thermowell.

In another embodiment, the present invention is an assembly for monitoring and controlling the heating of a process in a reservoir that includes a heater, a control unit, a first and second conduit, and a temperature sensor. The heater has heating elements that extend into the process. The first conduit is attached to the heater and the second conduit is attached to the control unit. The first conduit is rotatably attached to the second conduit. The control unit has a housing, a control panel, and control circuitry. The temperature sensor measures a temperature of the process and is electrically connected to the control circuitry to provide the measured temperature to the control unit. The housing of the control unit has an opening to communicate a plurality of power wires through the first and second conduits. The power wires are electrically connected between the heater and the control circuitry of the control unit.

The control circuitry of the control unit is capable of controlling the power supplied through the power wires to the heater. The control circuitry is also capable of monitoring a current supplied to the heater. The control panel of the control unit is capable of being radially oriented with respect to the heater to allow for easy access to the control panel by an operator. The heater may have a thermowell that extends into the process. A thermowell adapter may be used for mounting the temperature sensor inside the thermowell.

In a further embodiment, the present invention is an integrated unit for monitoring and controlling the heating of a process. The integrated unit includes a heater, a control unit, a temperature sensor, and a means for coupling the control unit to the heater. In this embodiment, the heater has heating elements and a thermowell that extend into the process. The control unit controls the power to the heating elements of the heater. The temperature sensor is mounted within the thermowell of the heater by a thermowell adapter so that it is capable of measuring a temperature of the process. The temperature sensor provides the measured temperature to the control unit. The coupling means is capable of radially orienting the control unit with respect to the heater.

The coupling means may further include: a means for attaching a first conduit to the heater; a means for attaching a second conduit to the control unit; a means for connecting a plurality of power wires from the control unit to the heater; a means for installing one of the first or second conduits on the other conduit; and a means for attaching the first conduit to the second conduit.

Another embodiment of the present invention includes a method for monitoring and controlling the heating of a process in a reservoir. The method includes the steps of: attaching a first conduit to a control unit so that a plurality of power wires from the control unit extend from an opening in the control unit and into the first conduit; attaching a second conduit to a heater so that a plurality of terminals on the heater extend within the second conduit; attaching the heater to the reservoir so that a heating element of the heater extends into the process; connecting the plurality of power wires from the control unit to the plurality of terminals from the heater; inserting one of the first or second conduits into the other conduit; orienting the control unit radially with respect to the heater to a selected radial orientation; and maintaining the selected radial orientation by fastening the first conduit to the second conduit. The fastening of the first conduit to the second conduit may include inserting a bolt through a locking slot in the first conduit and threading the bolt in a locking hole in the second conduit. The step of orienting the control unit radially with respect to the heater to the selected orientation may further include selectively orienting access to a control panel on the control unit from above, below, or either side of the control unit.

The method may further include the step of mounting a temperature sensor inside a thermowell in the heater and electrically connecting the temperature sensor to the control unit. The mounting step may include the additional steps of: threading a bayonet adapter to a compression fitting; pressing the compression fitting into the thermowell; inserting the temperature sensor in a bayonet cap; installing a portion of the bayonet cap into the bayonet adapter; and locking the bayonet cap to the bayonet adapter.

The above summary of the present invention is not intended to represent each embodiment, or every aspect of the present invention. This is the purpose of the figures and detailed description that follows.

BRIEF DESCRIPTION OF THE DRAWINGS

Other objects and advantages of the invention will become apparent upon reading the followed detailed description and upon reference to the drawings.

The foregoing and other aspects of the present invention will be best understood with reference to a detailed description of specific embodiments of the invention, which follows, when read in conjunction with the accompanying drawings, in which.

Figure 1:
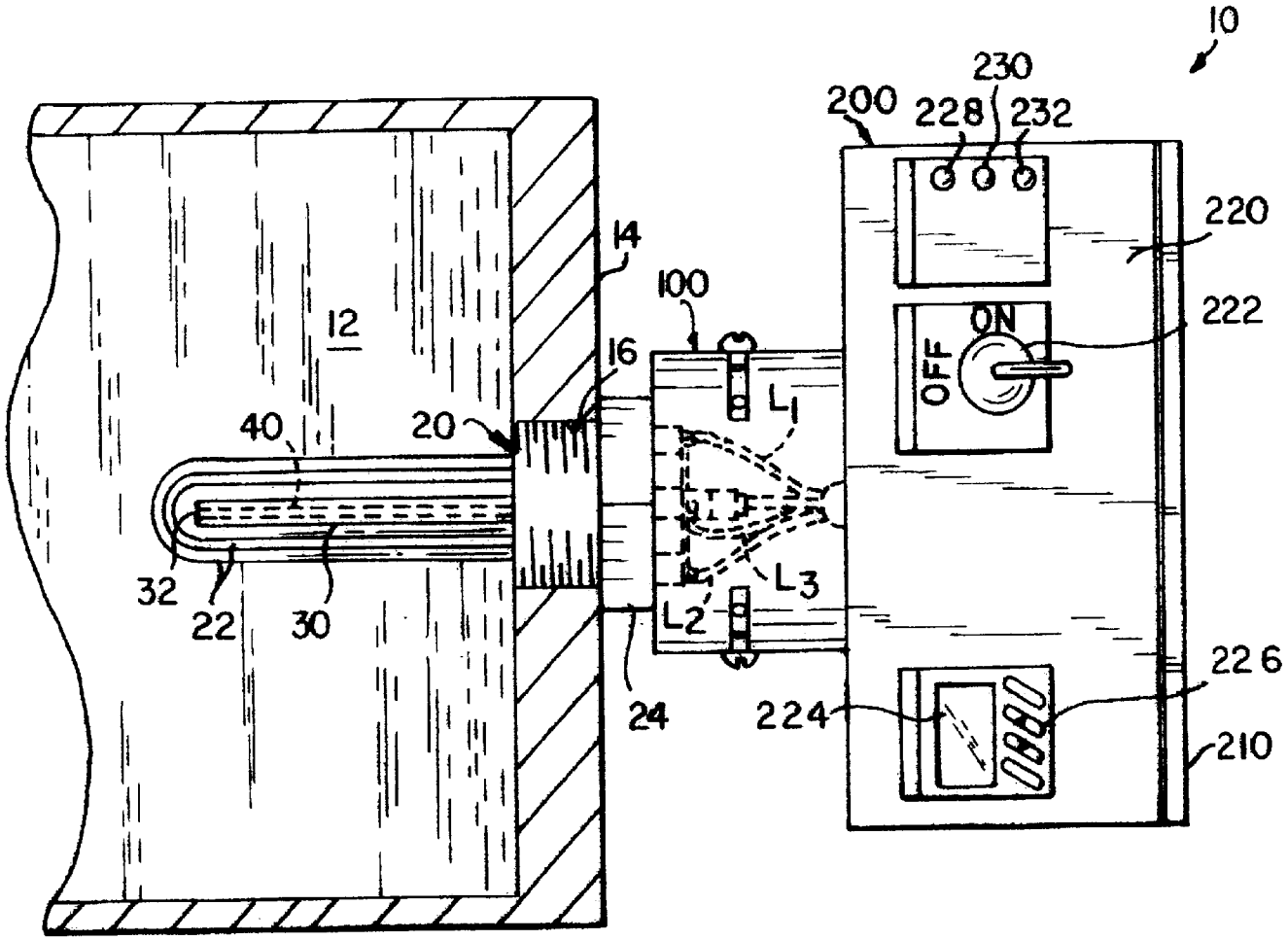
FIG. 1 illustrates a reservoir having an integrated heater and controller assembly according to the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the scope of the invention as defined by the appended claims.

DETAILED DESCRIPTION OF THE INVENTION

Illustrative embodiments will now be described with reference to the accompanying figures. Turning to the drawings, FIG. 1 illustrates an integrated heater and controller assembly 10 for monitoring and controlling the temperature of a process 12 within a reservoir 14. The reservoir 14 may be an open or closed container, and the process 12 may be water or other fluid or solution that requires heating.

In one embodiment, the integrated heater and controller assembly 10 includes a heater 20, a temperature sensor 40, a coupling adapter 100, and a control unit 200. The heater 20, such as a screw plug or flanged heater, is installed in an opening 16 in the reservoir 14. For screw plug or flanged heaters, the heater 20 has heating elements 22 and a base 24. The heating elements 22 extend from the base 24 and within the reservoir 14 to apply heat directly to the process 12. The base 24 is used to mount the heater 20 to the wall of the reservoir 14.

The heater 20 may also have a thermowell 30 that extends directly into the process 12. In one embodiment, the thermowell 30 is a closed end tube that is mounted directly to the base 24 of the heater 20. The closed end 32 of the thermowell 30 extends into the process 12. The thermowell 30 is designed to protect an operator and the temperature sensor 40 from the process 12. A thermowell 30 is typically necessary in situations where the process 12 is under pressure or corrosive. The temperature sensor 40 is contained within the thermowell 30 and monitors the temperature of the process 12 for the control unit 200.

The coupling adapter 100 is used to physically attach the control unit 200 to the heater 20. The control unit 200 is also electrically connected to the heater 20 and the temperature sensor 40 by wires. As explained in more detail below, the control unit 200 receives signals from the temperature sensor 40 to monitor the temperature of the process 12 and controls the temperature of the process by turning on and off power to the heating elements 22.

If the temperature sensor 40 is a bulb and capillary type sensor, the temperature sensor 40 may be press fit into the thermowell 30. Other types of temperature sensors, such as thermocouples and RTD probes, will require a thermowell adapter. A suitable thermowell adapter is described in co-pending, commonly assigned, patent application Ser. No. 09/782,264, entitled "Universal Thermowell Adapter Assembly", by John Henrie et al., filed on Feb. 13, 2001, the specification of which is incorporated herein by reference in its entirety.

Figure 2:
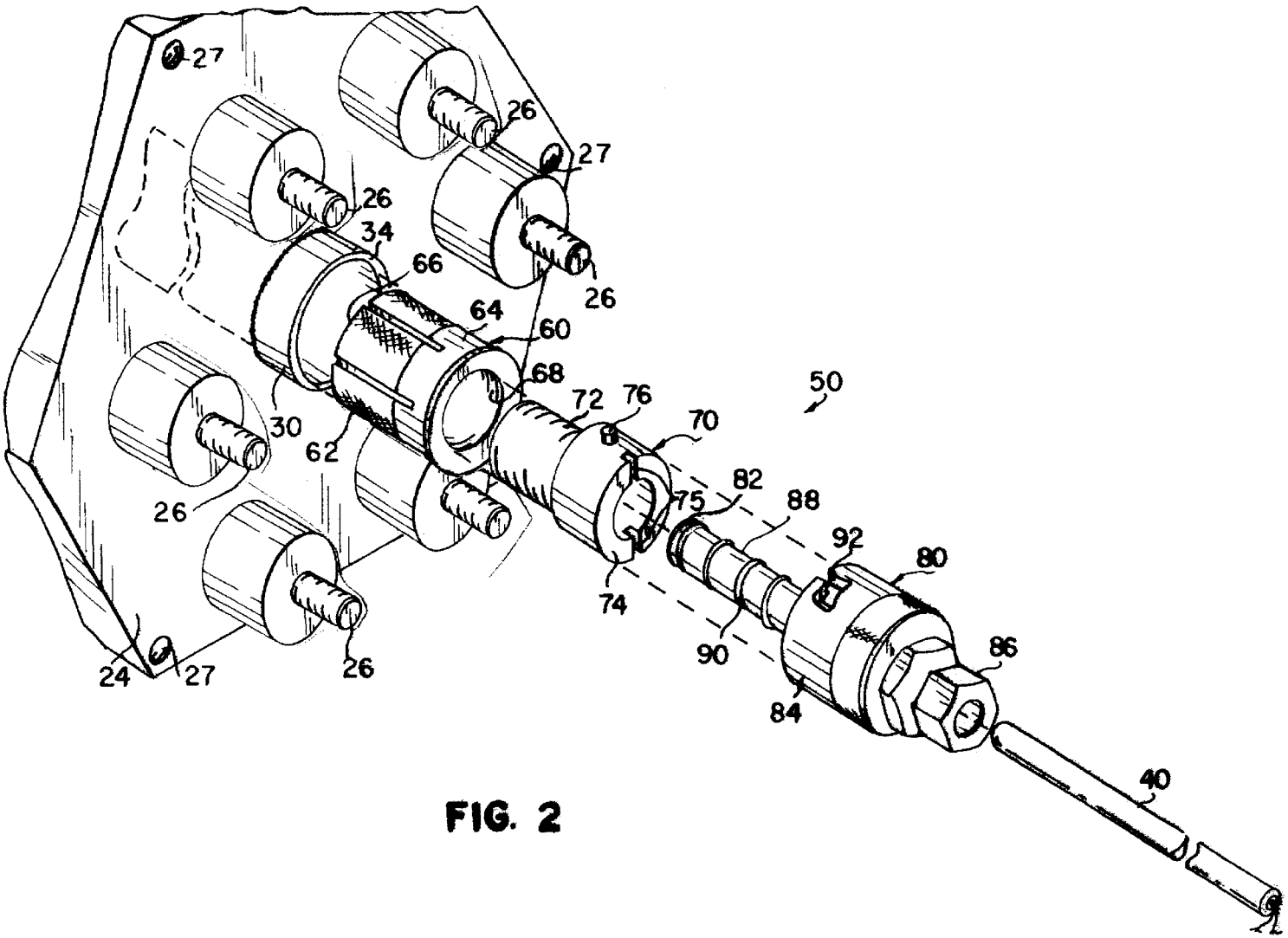
FIG. 2 illustrates an exploded view of one embodiment of a thermowell adapter.

FIG. 2 shows one type of thermowell adapter 50 in relation to the thermowell 30 and the temperature sensor 40. In one embodiment, the thermowell adapter 50 includes a compression fitting 60, a bayonet adapter 70, and a bayonet cap 80. The compression fitting 60 has a knurled portion 62 and a head portion 64. The knurled exterior of the knurled portion 62 defines a matrix of raised bumps on the outer surface of the compression fitting 60. Patent application Ser. No. 09/782,264, "Universal Thermowell Adapter Assembly," shows other embodiments of the compression fitting 60 having ridges or longitudinal protrusions. The compression fitting 60 includes flanges 66 that are defined by slots in the compression fitting 60. The compression fitting 60 further includes an aperture extending through the center of the compression fitting 60. The compression fitting 60 has internal threads 68 that run along the internal aperture of the compression fitting 60. The compression fitting 60 is preferrably made of a softer metal such as brass or aluminum. However, nonmetallic materials such as plastic or Teflon may be used. The length and diameter of the compression fitting 60 varies based on the size of the thermowell 30. In one embodiment, where the internal diameter of the thermowell 30 is 0.472 inch, the external diameter of the compression fitting 60 is about 0.451 inch and the length of the compression fitting 60 is about 0.625 inch.

The bayonet adapter 70 has external threads 72 and a head portion 74. The head portion 74 has a locking pin 76. The external threads 72 of the bayonet adapter 70 are inserted into the internal threads 68 of the compression fitting 60. Thus, the threads 72 of the bayonet adapter 70 and the threads 68 of the compression fitting 60 must be compatible. The internal threads of stock brass fittings are of the coarse type. Accordingly, if stock brass fittings are used, the external threads of the bayonet adapter must be customized to match the coarse type of threads of stock brass fittings. In one embodiment, the compression fitting 60 is a stock brass compression fitting having internal threads 68 of a coarse type, such as 3/8"−16. The external threads 72 of the bayonet adapter would then be customized to also be of the coarse type 3/8"−16. However, it should be understood that the present invention is not limited to this type and size of threads. What is important is that the threads of the compression fitting 60 match the threads of the bayonet adapter 70.

The knurled portion 62 of the compression fitting 60 is inserted into the open end 34 of the thermowell 30. The external diameter of the knurled portion 62 of the compression fitting 60 is sized so that the compression fitting 60 is frictionally retained inside the thermowell 30. It is noted that the compression fitting 60 may not adequately hold inside the thermowell 30 until the bayonet adapter 70 has been threaded into the compression fitting 60. When the compression fitting 60 has been inserted into the thermowell 30, the force of the threads 72 of the bayonet adapter 70 splits the compression fitting 60 outward assuring a tight fit. The use of a softer material, such as brass, for the compression fitting 60 reduces the amount of force required to "split" the compression fitting 60. Moreover, brass is preferred because it has a higher coefficient of expansion than common materials used for thermowells. This allows the fitting to get tighter as the system gets hotter.

Additional force may be necessary to insert the compression fitting 60 into the thermowell 30. This is due to the fact that the internal diameter of the thermowell 30 may be reduced due to welding the thermowell 30 to the base 24 of the heater 20. Using a small hammer, the assembled bayonet adapter 70 and compression fitting 60 may be tapped into the thermowell 30. The flanges 66 of the compression fitting 60 enable the fitting to be frictionally retained in the thermowell 30. The advantage of using a compression fitting 60 is that it requires no special tools and overcomes expensive retrofitting operations.

The bayonet cap 80 has a bayonet end 82, a locking cap 84, and a locking nut 86. The bayonet end 82 is defined by a tube 88 and a spring 90. The spring 90 is disposed along the exterior surface of the tube 88. The locking cap 84 slides along the exterior surface of the tube 88 but is held against the locking nut 86 by spring 90. The temperature sensor 40 slides through the locking nut 86, the locking cap 84 and the tube 88 of the bayonet end 82. The temperature sensor 40 may be a variety of types including without limitation an RTD or thermocouple. In one embodiment, a type "J" thermocouple is used. The assembled bayonet end 82 and temperature sensor 30 are inserted into an aperture in the head portion 74 of the bayonet adapter 70. The temperature sensor 40 is positioned so that the tip of the temperature sensor 30 touches the closed end 32 of the thermowell 30. The locking nut 86 is turned to lock the temperature sensor 40 into position. The locking pin 76 of the bayonet adapter 70 slides into a channel 92 on the locking cap 84. The purpose of spring 90 is to maintain physical contact between the temperature sensor 40 and the closed end 32 of the thermowell 30, thereby assuring accurate measurement of the process 12 in the reservoir 10.

Figure 3A:
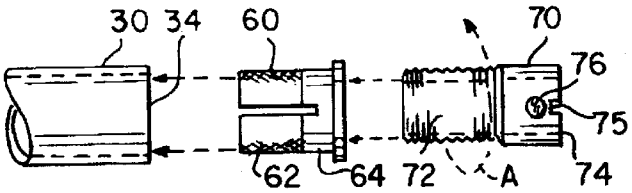
FIGS. 3A–3C illustrates various side views of the thermowell adapter in FIG. 1 during assembly operations.
Figure 3B:
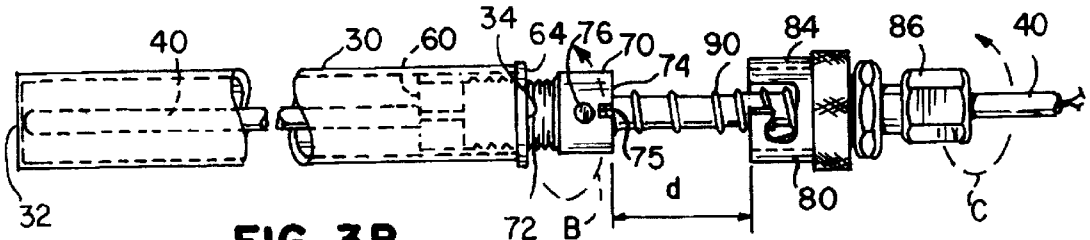
Figure 3C:
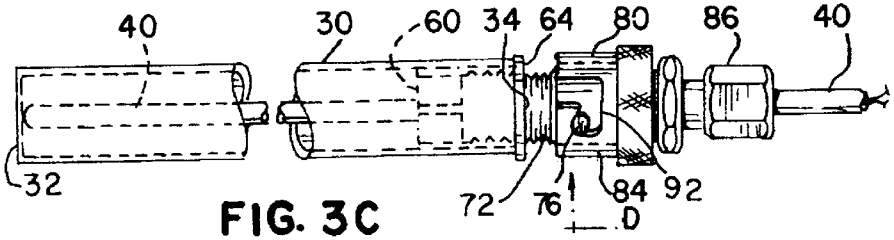

FIGS. 3A–3C present a method to install a thermowell adapter 50 and temperature sensor 40 into thermowell 30. As shown in FIG. 3A, the exterior threads 72 of the bayonet adapter 70 is mated to the internal threads 68 of the compression fitting 60. The bayonet adapter 70 is then turned one full turn in the A direction. Welds at the open end 34 of the thermowell 30 or other hindrances may interfere with the insertion of the compression fitting 60 into the thermowell opening. Additional force may be required to install the compression fitting 60. Accordingly, a small hammer may be used to tap the assembled compression fitting 60 and bayonet adapter 70 into the open end 34 of the thermowell 30. The compression fitting 60 is pressed into the thermowell 30 until the compression fitting is flush with the thermowell 30.

As shown in FIG. 3B, after the compression fitting 60 is secure in the thermowell 30, the bayonet adapter 70 is threaded the rest of the way into the compression fitting 60 or until tight. This is done by turning the bayonet adapter 70 in direction B. To assist the turning of the threaded bayonet adapter 70, a slot 75 may be machined into the head portion 74 of the bayonet adapter 70. A tool may be inserted into the machined slot to provide additional torque when turning the bayonet adapter 70.

A temperature sensor 40 is then inserted into the bayonet cap 80. The assembled sensor 40 and bayonet cap 80 is inserted into the bayonet adapter 70. The temperature sensor 40 is positioned so that the end of the sensor touches the closed end 32 of the thermowell 30. With the temperature sensor 40 firmly held against the closed end 32 of the thermowell 30, the locking cap 84 of the bayonet cap 80 is positioned a relatively short distance d from the bayonet adapter 70. In one embodiment, the distance d is about 0.06 to 0.25 inches. The locking nut 86 of the bayonet cap 80 is tightened in direction C to lock the bayonet cap 80 to the temperature sensor 40.

As shown in FIG. 3C, with the bayonet cap 80 and the temperature sensor 40 locked together, the bayonet cap 80 is mated with the bayonet adapter 70 by moving the locking cap 84 in direction D. This is done by turning the channel 92 of the locking cap 84 over the locking pin 76. The contact of the sensor 40 and the closed end 32 of the thermowell 30 compresses the spring 90 on the bayonet cap 80 to hold the sensor against the closed end 32 of the thermowell 30. At this time, it is best to ensure that all connections are secure and tight.

Referring to FIG. 1, it is preferred that the thermowell 30 is disposed in the base 24 of the heater 20: however, the thermowell 30 may be separately located in the wall of the reservoir 14. Further embodiments of a thermowell adapter are described in patent application Ser. No. 09/782,264, entitled "Universal Thermowell Adapter Assembly."

As indicated above, the control unit 200 is electrically connected to the temperature sensor 40. This allows the control unit 200 to monitor the temperature of the process 12. The control unit 200 is also electrically connected to the heater 20. As shown in FIG. 2, the base 24 of the heater 20 has a plurality of terminals 26. The terminals 26 provide the electrical interface to the heating elements 22. The base 24 of the heater 20 has screw holes 27 for physically mounting the coupling adapter 100 to the heater 20.

Figure 4A:
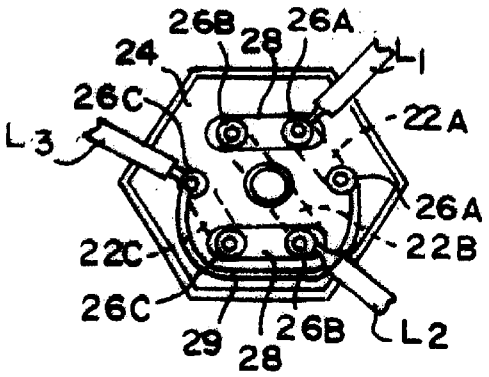
FIGS. 4A–4C illustrates plan views of different wiring configurations for the base of the heater.
Figure 5A:
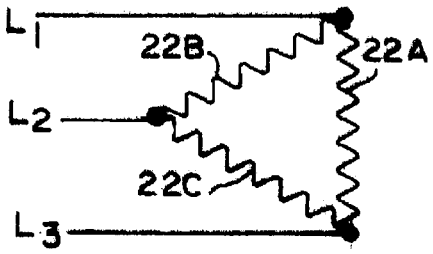
FIGS. 5A–5C illustrate electrical schematics of the wiring configurations illustrated in FIGS. 4A–4C.

FIGS. 4A–4C and 5A–5C illustrate different wiring configurations to electrically connect the control unit 200 to the heater 20. In particular, FIG. 4A shows a plan view of the base 24 of the heater 20 for a three-phase Delta wired heater. The heater has three resistive heating elements 22A–C that have corresponding electrical terminals 26A–C. A three-phase Delta wired heater is connected via terminals 26A–C to three phase wires L1, L2, L3. Two bus bars 28 are used for two of the phase wires L1, L2. The bus bars 28 connect heating element 22A to heating element 22B and connect heating element 22B to heating element 22C. A bus bar cannot be used to connect heating element 22A to heating element 22C because it would block access to the thermowell 30. Accordingly, a jumper wire 29 is used to make the connection between heating elements 22A and 22C. An electrical schematic representation of a three-phase Delta circuit for this embodiment is shown in FIG. 5A.

Figure 4B:
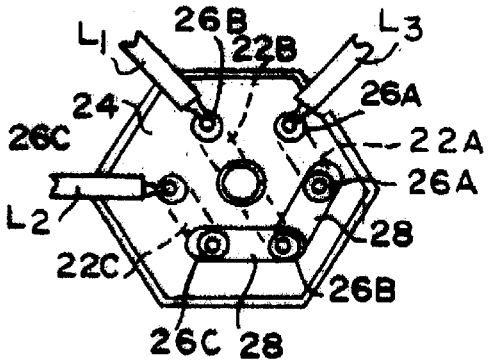
Figure 5B:
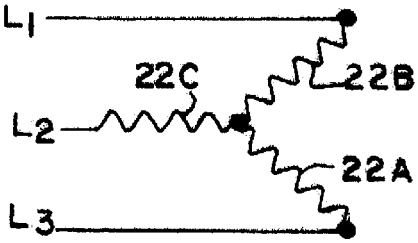

The present invention is also applicable to other types of wired heaters. For example, FIG. 4B shows a plan view of the base 24 of the heater 20 where the heater 20 is a three-phase Wye wired heater. The three-phase Wye wired heater is connected via terminals 26A–C to three phase wires L1, L2, L3. Bus bars 28 are used to connect heating elements 22A and 22B to heating element 22C. The phase wires L1, L2, L3 are electrically connected to heating elements 22B, 22C and 22A, respectively. An electrical schematic representation of a three-phase Wye circuit for this embodiment is shown in FIG. 5B.

Figure 4C:
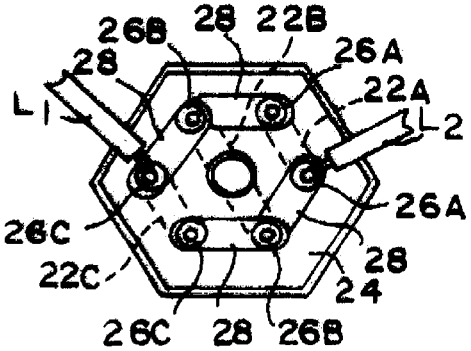
Figure 5C:
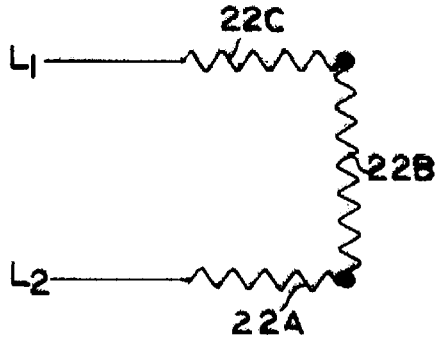

FIG. 4C shows a plan view of the base 24 of the heater 20 where the heater 20 is a single-phase wired heater. In one embodiment, power wire L1 is connected to heating element 22C via terminal 26C and power wire L2 is connected to heating element 22A via terminal 26A. Bus bars 28 are used to connect the heating elements 22A–C as shown in FIG. 4C. An electrical schematic representation of such a wired heater is shown in FIG. 5C.

As discussed above with reference to FIG. 1, the coupling adapter 100 physically attaches the control unit 200 to the heater 20. More specifically, the coupling adapter 100 cantilevers the control unit 200 on the heater 20 so that the control unit 200 projects directly outside of the reservoir 14. The coupling adapter 100 thermally isolates the control unit 200 from the heater 20 and allows the control unit 200 to orient relative to the heater 20. The coupling adapter 100 also provides a passageway for the wires from the control unit 200 to the heater 20. Power wires L1, L2, L3 from the control unit 200 pass through the coupling adapter 100 and connect to the terminals 26 of the heating elements 22. Also, a sensor wire S1 from the control unit 200 may also pass through the coupling adapter 100 and may connect to the temperature sensor 40 in the thermowell 30. It is further contemplated, that ground wires (not shown) for the heater may pass through the coupling adapter 100.

Figure 6:
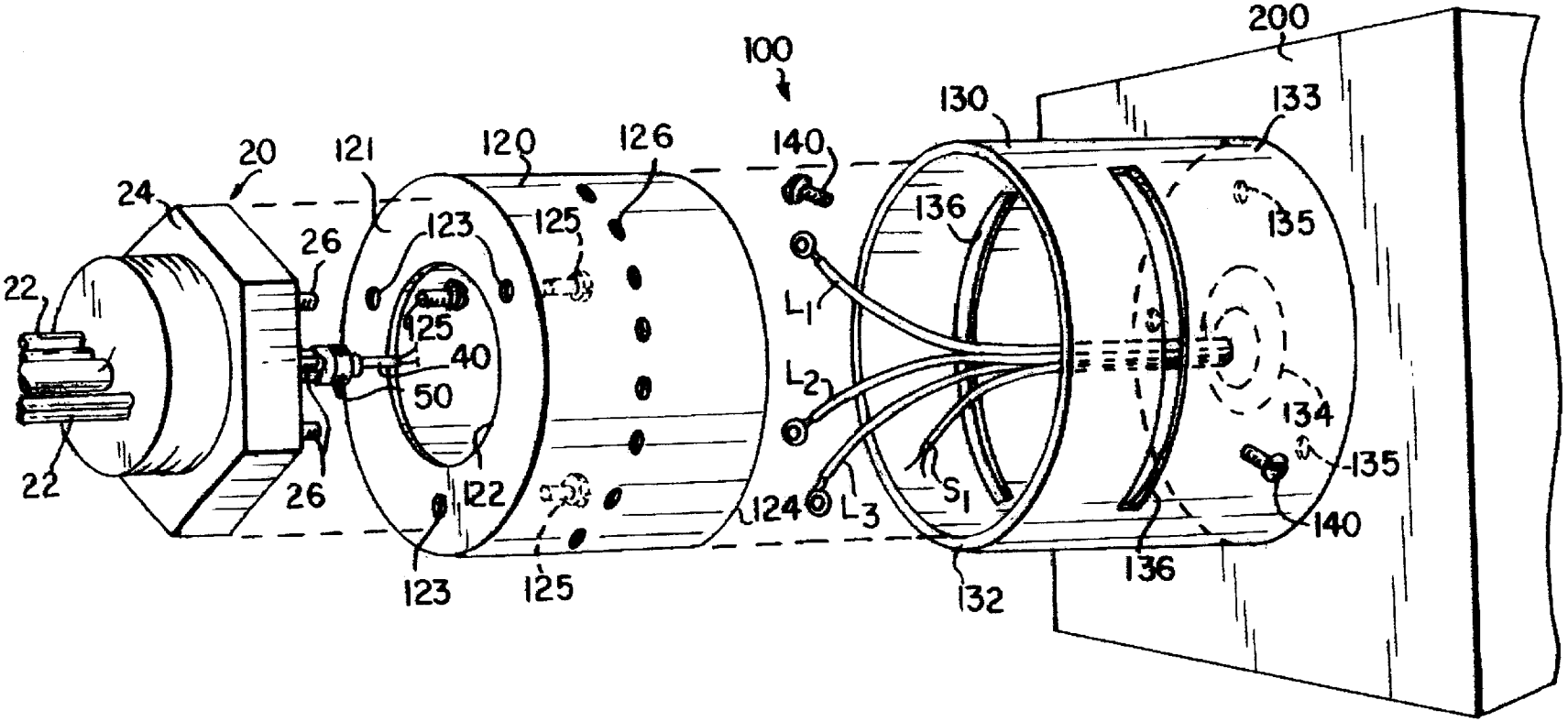
FIG. 6 illustrates an exploded view of one embodiment of a coupling adapter.

Referring now to FIG. 6, one embodiment of the coupling adapter 100 is shown in an exploded view. Suitable coupling adapters are also described in co-pending, commonly assigned, patent application Ser. No. 09/753,872, entitled "Adapter Assembly for Heaters and the Like", filed Jan. 3, 2001, the specification of which is incorporated herein by reference in its entirety. The heating elements 22 of the heater 20 extend from the heater base 24 and into the process 12. In this embodiment, the thermowell 30 mounts in the base 24 and extends adjacent to the heating elements 22. On the exterior end of the heater 20, terminals 26 extend from the heater base 24 for attachment to power wires L1, L2, L3 described above. In addition, if a thermowell adapter is used, the thermowell adapter 50 projects from the heater base 24.

The coupling adapter 100 may have an inner conduit 120 and an outer conduit 130. The coupling adapter 100 is used to attach the heater 20 to the control unit 200. In one embodiment, the inner conduit 120 of the coupling adapter 100 attaches to the heater 20. The inner conduit 120 has a inner flange 121 with an opening 122 to accommodate the extending terminals 26 on the heater base 24. The inner flange 121 has screw holes 123. Screws or bolts 125 are inserted though the holes 123 and into the screw holes 27 (see FIG. 2) of the heater base 24. Multiple sets of mounting holes may be provided to allow the coupling adapter 100 to function with standard sized immersion heaters.

The inner conduit 120 has a second opening 124 at an opposite end. The inner conduit 120 also has a plurality of locking holes 126 that form a ring of holes that circumscribes the outer surface of the conduit 120. The locking holes 126 in one embodiment contain threads.

An outer conduit 130 of the coupling adapter 100 attaches to a control unit 200. The outer conduit 130 has an inner flange 133 with an opening 134 at its end to accommodate the power wires L1, L2, L3 and sensor wire S1 from the back of the control unit 200. The wires extend through the conduit 130 and exit an opening 132 at an opposite end of the conduit 130. The power wires are provided with terminal connectors for connection to the terminals 26 on the heater base 24. The inner flange 133 has screw holes 135. Screws or bolts (not shown) are inserted though the holes 135 and into the back of the control unit 200.

The outer conduit 130 also has a plurality of locking slots 136 that form a ring of slots that circumscribes the outer surface of the conduit 130. The location of the locking slots 136 substantially encompasses the location of locking holes 120 when the outer conduit 130 axially installs on the inner conduit 120.

Although the present embodiment and other embodiments disclosed herein describe the use of mounting holes and screws for attaching the adapter portions to the base of the heater and/or control unit, it is understood that a variety of ways to fasten the adapter portions to the heater base or control unit exist. For example, the conduit portions can be welded to the heater base or control unit. Other examples include: extruded flanges, welded flanges and nuts threaded onto bolts. Those skilled in the art having the benefit of this disclosure will readily conceive of alternative means for attaching the conduit portions to the heater base or control unit. All such equivalents are applicable to the present invention.

The power wires L1, L2, L3 route through the conduits 120, 130 and attach to the terminals 26. The sensor wire S1 routes through the conduits 120, 130 and attaches to the temperature sensor 40. Although not shown, it is contemplated that a ground wire for the heater 20 may be routed through conduits 120, 130. The outer conduit 130 on the control unit 200 slips over the inner conduit 120 on screw plug heater 110. Once the two conduits 120, 130 are mated together, the control unit 200 may be rotated to any orientation around 360 degrees. The adapter facilitates 360 degrees of rotational adjustment to optimize the orientation of the attached control unit 200 for best functionality. Because the locking slots 136 align in axial depth along the two conduits 120, 130 with the locking holes 126, some of the redundant locking holes 126 remain accessible through the locking slots 136 despite radial movement of the outer conduit 130 with respect to the inner conduit 120.

It is understood that having the inner conduit 120 attach to the heater 20 and the outer conduit 130 attach to the control unit 200 is strictly an arbitrary designation. An equivalent embodiment exists having the reverse attachments. Specifically, the inner conduit 120 may attach to the control unit 200, while the outer conduit 130 may attach to the heater 20. This is also explained in co-pending, commonly assigned, patent application Ser. No. 09/753,872, entitled "Adapter Assembly for Heaters and the Like."

Although the present embodiments and others disclosed herein depict the adapter as having an inner and outer cylinder, other geometrical shapes for the conduits besides cylinders could still be used. These geometrical shapes could still allow for the conduits to fit over one another and provide for radial orientation of the two conduits with respect to one another. For example, both conduits could have complimentary conical shapes or bell-shapes. Other more exotic geometries exist that allow for the equivalent benefits of inserting one conduit into another and providing angular orientation of the conduits with respect to one another.

After situating the control unit 200 to a desired orientation, depending on the application and required location of the control unit 200, a plurality of locking bolts 140 insert through the locking slots 136 in the outer conduit 130. The locking bolts 140 thread into the locking holes 126 in the inner conduit 120. The control unit 200 is thus kept in place. Note that the design of the present invention allows an operator to easily access the bolts or screws 140 within the confined space between the control unit 200 and the heater 20.

The control unit 200 includes all the required electronics and devices to reliably monitor and control the heating of the process 12 with the heater 20. The control unit 200 powers the heating elements 22 to heat the process 12 and monitors the temperature of the process 12 with the sensor 40. The control unit 200 also detects alarm conditions in the process 12 and heater 20.

The control unit 200 includes a housing 210, a control panel 220, and control circuitry 240. The housing 210 provides the structure for mounting the control panel 220 and the control circuitry 240. The control panel 220 provides the user interface to control and monitor the heating of the process 12. In one embodiment, referring to FIG. 1, the control panel includes an on/off switch 222, a display 224, input keys 226 and light indicators 228, 230, 232. The on/off switch 222 enables an operator to turn the power on or off to the control circuitry 240. After an operator turns the switch 222 on, the operator can set or program temperatures, alarm conditions and other implementation specific features. A display 224 is used to assist the user with inputting information or selecting features through the input keys 226. The control panel 220 may also have one or more light indicators 228, 230, 232 to inform an operator of conditions. Although the specific conditions are implementation specific, the indicators may include an indication that the heater is on, an alarm condition is met, or that the heater has failed. For example, light indicator 228 may indicate that heat is being applied by the heater 20 to the process 12. Another light indicator 230 may indicate a high or low temperature alarm based on setpoints configured by an operator through input keys 226. Another light indicator 232 may indicate that the heater has failed or needs servicing based on the measured current by the control circuitry 240.

The control panel 220 is preferably positioned on a side of the control unit 200. Having the panel 220 on a side of the housing 210 makes the controls accessible even when the control unit 200 must be placed in awkward locations. In addition, the orientation of the control panel 220 can be set when attaching the control unit 200 to the heater 20 with the coupling adapter 100. When coupling the housing 210 of the control unit 200 to the heater 20, an operator may specifically orient the control panel 220 for easy access to the controls.

For example, if the heater 20 and control unit 200 are positioned low on the reservoir 12 near the ground, the control unit 200 may be rotated on the coupling adapter 100 so that the control panel 220 may be viewed from above. If the control unit 200 extends horizontally from the reservoir 12 at about eye level, having the control panel 220 on the side allows the controls to be viewed on either the left or the right. In addition, if the control unit 200 must be placed above the eye level of the operator, then the control unit 200 may be rotated so that the control panel 220 may be easily viewed from below.

A suitable embodiment of the control circuitry 240 is shown in FIG. 4. The control circuitry 240 provides advanced control and monitoring options, operator input features, and operator indicators.

Figure 7:
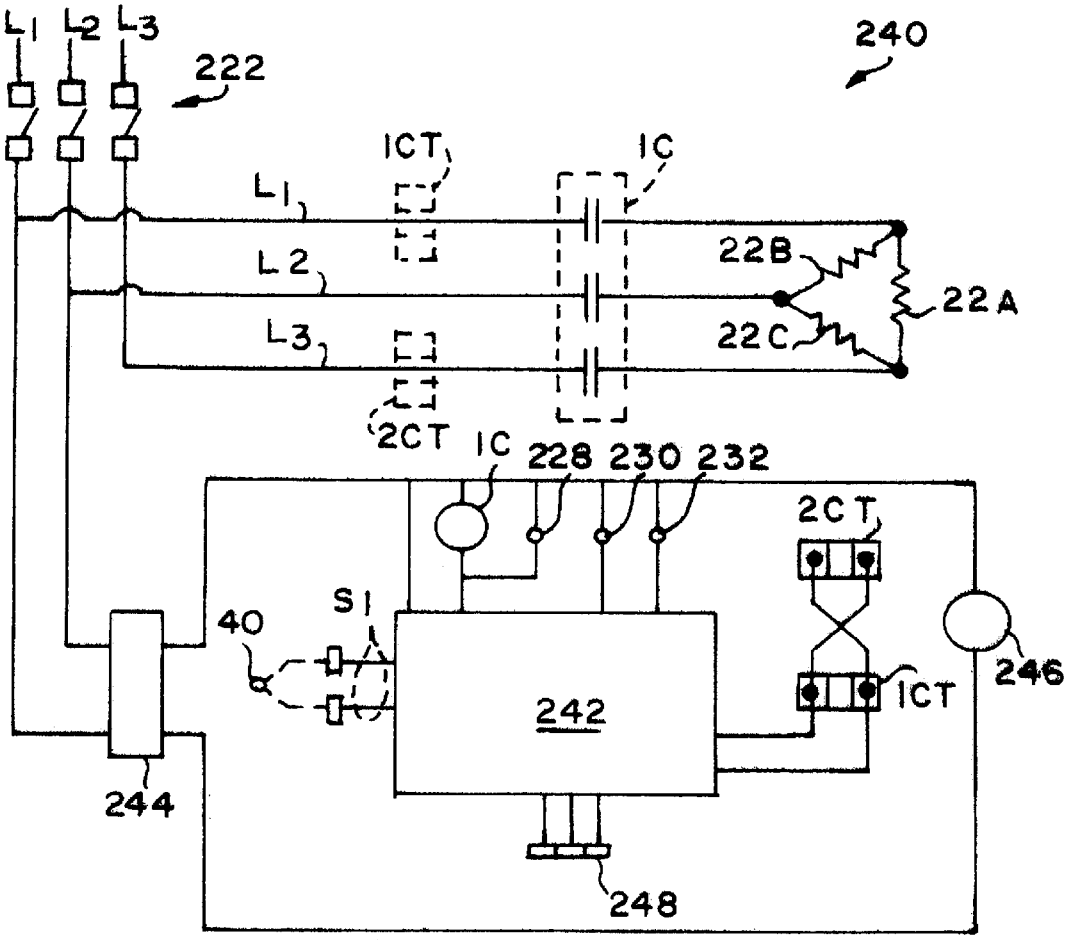
FIG. 7 illustrates a schematic embodiment of control circuitry for a control unit according to the present invention.

In one embodiment, the main components of the control circuitry 240 includes current transformers 1CT, 2CT, an isolation contractor IC, an integrated temperature controller (ITC) 242, and a transformer unit 244. The embodiment shown in FIG. 7 is based on a three-phase power source from wires L1, L2, L3. The present invention, however, is not limited to three-phase power sources and a person of ordinary skill in the art with the benefit of the present specification would realize that other types of power sources could be used including single-phase power sources. The control circuitry 240 may also include a fan 246 mounted to the housing 210 to provide convection cooling to the various components of the control circuitry 240.

The control circuitry 240 is provided power from power lines L1, L2, L3. The power switch 222 is connected between the incoming power lines L1, L2, L3 and the control circuitry 240. When the power switch 222 is turned on by an operator, power is supplied to the control circuitry 240.

The power lines L1, L2, L3 connect from the power switch 222 to a heater 20 (having heating elements 22A, 22B and 22C), shown here with a three-phase Delta wiring. The present invention, however, is not limited to three-phase Delta wiring. For example, other types of wiring configurations such as those shown in FIGS. 5B and 5C may be used. For illustrative purposes, a three-phase Delta wiring configuration is described. In such an embodiment, intervening circuitry intercepts the power lines L1, L2, L3 before they connect to the heating elements 22A–C. Two current transformers 1CT, 2CT respectively encompass the power lines L1 and L3 and monitor the current passing through their respective lines L1 and L3. Also, the isolation contactor IC intercepts all of the power lines L1, L2, L3 before they connect to the heating elements 22A–C. Further details of the current transformers 1CT, 2CT and the isolation contactor 1C are provided below.

Power from the lines L1 and L2 diverts to the transformer unit 244, where the power supply is stepped to a desired level. The power from the transformer unit 244 supplies the integrated temperature controller (ITC) 242 and other components with power. The ITC 242 controls and monitors the heating and sensing for the assembly. The ITC 242 is used in conjunction with appropriate mathematical models, e.g., on/off, proportional-integral-derivative (PID) control, statistical models or other modular assemblies, for monitoring and controlling the heating of the process.

The ITC 242 may have microprocessors, PID controls, relays, circuit breakers, sensor inputs and control outputs. The parameters and functions for the ITC 242 may be programmed or changed according to the needs of a particular installation and are within the knowledge of one of ordinary skill in the art. In a preferred embodiment, the ITC 242 manages the process with PID control having an autotuning feature.

The ITC 242 couples to the isolation contactor IC and controls the power supplied to the heating elements 22A–C. When the isolation contactor IC connects the heating elements 22A–C to the power lines L1, L2, L3, a "heater on" indicator 228 illuminates to show that the heating elements 22A–C are in operation. In addition, the ITC 242 provides indication of alarm conditions, such as a temperature alarm 230 for a high temperature level. A heater service alarm 232 may also indicate when current levels deviate or a ground fault occurs. Other alarms may include high, low and deviation selectable alarms for temperature and current.

To monitor the temperature of the process, the ITC 242 is electrically connected to the temperature sensor 40 via sensor wire S1. To monitor the current in the power lines and indicate an alarm condition, the ITC 242 is electrically connected to the current transformers 1CT, 2CT. The first current transformer monitors the current in power line L1, and the second current transformer monitors the current in power line L3.

The current transformers 1CT, 2CT detect failures in the individual heating elements 22A–C of the heater 20. Heating element failure is defined as an open circuit within the element. The two current transformers 1CT, 2CT are wired in series on the power lines L1 and L3 so that individual heating element failure can be detected for a three-phase "Delta" wired heater. When an element failure occurs due to a ground fault in one of the heating elements 22A–C, the service heater alarm 232 activates.

The ITC 242 may also connect to digital connections 248 so that digital communication may be available from the control circuitry 240. The ITC 242 may be further compatible with a program or software (not shown). The fan 246 may be provided as part of the control circuitry 242 and coupled to the power supply of the transformer unit 244.

As further discussed above with reference to FIG. 1, the control unit 200 requires structural features to couple to the screw plug heater 20 and to provide for remote monitoring and control of the heating of the process 12. In particular, the control unit 200 is self-contained and can be used in the integrated heater and controller assembly 10. In addition, the control unit 200 facilitates remote access of the controls when oriented in relation to the heater 20.

Figure 8:
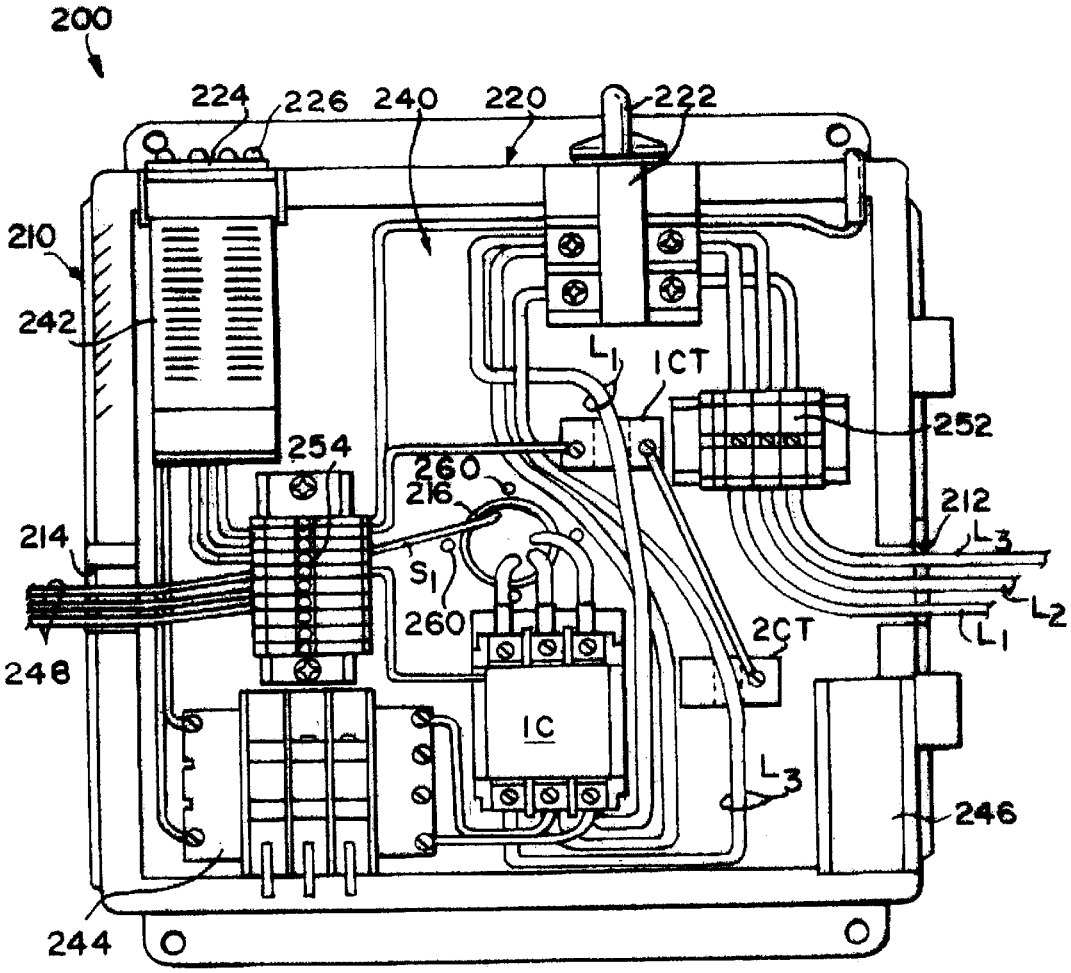
FIG. 8 illustrates an internal view of an embodiment of a control unit according to the present invention.

Referring now to FIG. 8, an internal view of an embodiment of the control unit 200 is illustrated. The control unit 200 includes a housing 210, shown with a face panel removed. Within the housing 210, the control unit 200 includes the control circuitry 240 as described above with reference to FIG. 4. The housing 210, itself, includes the an opening 212 for the power lines L1, L2, L3, an opening 214 for the digital communication lines 248, and an access opening 216 communicating with the coupling adapter 100, the heater 20, and temperature sensor 40.

The power lines L1, L2, L3 enter the control unit 200 through an access opening 212 and connect to a first terminal block 252. The use of the first terminal block 252 facilitates wiring by an operator among the components in close proximity within the housing 210. The power lines L1, L2, L3 connect from the terminal block 252 to the power switch 222. The power switch 222 has a knob on the control panel 220 that allows the operator to turn the control unit 200 and heater (not shown) on or off.

The power lines L1, L2, L3 connect from the power switch 222 to the isolation contactor IC. Power lines L1, L2, L3 from the isolation contactor IC exit the housing 210 through the access opening 216 in the back of the housing 210. The power lines L1, L2, L3 pass through the coupling adapter 100 and connect to a heater 20 as discussed above. A plurality of mounting holes 260 circumscribe the access opening 216 and allow the control unit 200 to attach to the coupling adapter 100.

The isolation contactor 1C also connects to the ITC 242. When actuated by the ITC 242, the isolation contactor 1C regulates the supply of power to the heater. Between the power switch 222 and the isolation contactor 1C, the first power line L1 has a first current transformer 1CT thereon, and the third power line L3 has a second current transformer 2CT thereon. The current transformers 1CT and 2CT are wired in series and connect to the ITC 242, which monitors the current in the lines for ground faults or current deviations.

The transformer unit 244 couples to the power lines L1 and L2 and supplies power to the integrated temperature controller (ITC) 242. The ITC 242 includes a display 224 and the input keys 226 on the control panel 220. As stated above, the control panel 220 advantageously positions on a side of the housing 210 of the control unit 200. The control panel 220 on the side of the housing 210 facilitates the use of the control unit 200 when the application requires the control unit 200 to be located in an awkward position. The display 224 may include a visual display of temperature levels or programmable parameters, such as set points and temperature indications. The input keys 226 allow an operator to set temperature and access functions or programs of the ITC 242. Also on the control panel 220, the ITC 242 connects to the indication lights 228, 230, 232, which may provide visual indications such as "heater on," temperature alarms, and heater service alarms.

The ITC 242 connects to a terminal block 254 for connection to various components, sensors and indicators. For example, the terminal block 254 includes connections for the temperature sensor 40. The sensor wire S1 connects from the terminal block 254 and passes out of the housing 210 through the access opening 216.

The sensor wire S1 then connects to the temperature sensor 40 for measuring the temperature of the process 12. The terminal block 254 also includes digital connections 248 for communication between the ITC 242 and an outside control source via digital communication lines.

Also contained in the housing 210 of the control unit 200 is the fan 246. The transformer unit 244 supplies power to the fan 246. The fan 246 cools the housing 210 by drawing in air and circulating it throughout the housing 210. Heat sources within the housing 210 may limit the size and type of housing 210 for the electronic circuitry. A smaller enclosure raises the internal ambient temperature in the housing 210, which may effect the electronics contained within. For example, an ambient greater than 50° C. in the housing 210 prohibits the use of a 16-DIN control unit for the ITC 242.

The fan 246 cools the circuitry in the housing 210 and allows the housing 210 to have a smaller size. A filter may also be provided so that particulate from outside the housing 210 may not enter. Of particular note, the presence of the fan 246 may further provide airflow in the coupling adapter 100 to thermally isolate the control unit 200 from the heater 20. Airflow in the housing 210 may enter the coupling adapter 100 through the access opening 216. The flow of air in the coupling adapter 100 helps further thermally isolate the control unit 200 from the heater 20.

What has been described is an integrated assembly 10 having a heater 20 and control unit 200 that uses adapters 50, 100 to provide a remotely mountable assembly for monitoring and controlling the heating of the process 12. The integrated assembly 10 makes operator installation easier. The coupling adapter 100 makes the assembly 10 compatible with various immersion heaters 20 of varying types and sizes, and the control unit 200 may be rotated with the coupling adapter 100 with respect to the heater 20. Therefore, the integrated assembly can be mounted in awkward positions without compromising the operator's ability to control and monitor the heating of the process 12. Furthermore, the thermowell adapter 50 makes the assembly compatible with thermowells having various sizes as well.

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. An assembly for monitoring and controlling the heating of a process in a reservoir, comprising:

a heater attached to the reservoir;

a coupling adapter, comprising:

a first tubular portion attached to the heater, a second tubular portion attached to the first tubular portion such that at least a portion of the first tubular is retained inside the second tubular portion;

at least one locking bolt attaching the first tubular portion to the second tubular portion, the locking bolt inserted through a hole in the second tubular portion;

a control unit attached to the second tubular portion, the control unit having wires communicating through a pathway in the first and second tubular portions and connecting to the heater; and a temperature sensor for measuring a temperature of the process, the temperature sensor electrically connected to the control unit to provide the temperature of the process to the control unit.

2. The assembly of claim 1, wherein the hole in the second tubular portion is a slot that enables the control unit to be readily oriented with respect to the first tubular portion when installing and attaching the second tubular portion to the first tubular portion.

3. The assembly of claim 2, wherein the first tubular portion has at least one threaded hole to receive the at least one locking bolt.

4. The assembly of claim 3, wherein a plurality of threaded holes circumscribes an outer surface of the first tubular portion, at least one of the plurality of threaded holes receiving the at least one locking bolt.

5. The assembly of claim 1, wherein the control unit has a housing, a control panel, and control circuitry, the control panel being readily accessible to an operator when the control unit is oriented relative to the heater.

6. The assembly of claim 1, wherein the heater has a thermowell that extends into the process, the assembly further comprises a thermowell adapter for mounting the temperature sensor to the thermowell.

7. The assembly of claim 6, wherein the thermowell adapter comprises:

a bayonet adapter;

a compression fitting attached to the bayonet adapter, the compression fitting installed in an open end of the thermowell; and a bayonet cap attached to the bayonet adapter;

a wherein the temperature sensor passes through the bayonet cap, the bayonet adapter and the compression fitting and into the thermowell.

8. The assembly of claim 1, wherein the control unit has control circuitry for controlling power supplied to the heater.

9. The assembly of claim 8, wherein the control circuitry of the control unit is capable of monitoring a current supplied to the heater.

10. The assembly of claim 1, wherein the wires of the control unit are connected to the heater as a three-phase Delta circuit.

11. An assembly for monitoring and controlling the heating of a process in a reservoir, comprising:

a heater attached to the reservoir;

a coupling adapter, comprising:

a first tubular portion attached to the heater, a second tubular portion attached to the first tubular portion such that at least a portion of the second tubular is retained inside the first tubular portion;

at least one locking bolt attaching the second tubular portion to the first tubular portion, the locking bolt inserted through a hole in the first tubular portion;

a control unit attached to the second tubular portion, the control unit having wires communicating through a pathway in the first and second tubular portions and connecting to the heater; and a temperature sensor for measuring a temperature of the process, the temperature sensor electrically connected to the control unit to provide the temperature of the process to the control unit.

12. The assembly of claim 11, wherein the hole in the first tubular portion is a slot that enables the control unit to be readily oriented with respect to the second tubular portion when installing and attaching the first tubular portion to the second tubular portion.

13. The assembly of claim 12, wherein the second tubular portion has at least one threaded hole to receive the at least one locking bolt.

14. The assembly of claim 13, wherein a plurality of threaded holes circumscribes an outer surface of the second tubular portion, at least one of the plurality of threaded holes receiving the at least one locking bolt.

15. The assembly of claim 11, wherein the control unit has a housing, a control panel, and control circuitry, the control panel being readily accessible to an operator when the control unit is oriented relative to the heater.

16. The assembly of claim 11, wherein the heater has a thermowell that extends into the process, the assembly further comprises a thermowell adapter for mounting the temperature sensor to the thermowell.

17. The assembly of claim 16, wherein the thermowell adapter comprises:

a bayonet adapter;

a compression fitting attached to the bayonet adapter, the compression fitting installed in an open end of the thermowell; and a bayonet cap attached to the bayonet adapter;

wherein the temperature sensor passes through the bayonet cap, the bayonet adapter and the compression fitting and into the thermowell.

18. The assembly of claim 11, wherein the control unit has control circuitry for controlling power supplied to the heater.

19. The assembly of claim 18, wherein the control circuitry of the control unit is capable of monitoring a current supplied to the heater.

20. The assembly of claim 11, wherein the wires of the control unit are connected to the heater as a three-phase Delta circuit.

21. An assembly for monitoring and controlling the heating of a process in a reservoir, comprising:

a heater attached to the reservoir, a first conduit attached to the heater;

a control unit having a housing, a control panel, and control circuitry;

a second conduit attached to the housing of the control unit, the first conduit rotatably attached to the second conduit; and a temperature sensor for measuring a temperature of the process, the temperature sensor electrically connected to the control circuitry of the control unit to provide the temperature to the control circuitry;

wherein the housing of the control unit has an opening to communicate a plurality of power wires through the first and second conduits, the power wires electrically connected between the heater and the control circuitry of the control unit.

22. The assembly of claim 21, wherein the control circuitry of the control unit is capable of controlling power supplied through the power wires to the heater.

23. The assembly of claim 21, wherein the control circuitry of the control unit is capable of monitoring a current supplied to the heater.

24. The assembly of claim 21, wherein the control panel of the control unit radially orients with respect to the heater allowing for easy access to the control panel by an operator.

25. The assembly of claim 21, wherein the heater has a thermowell that extends into the process, the assembly further comprises a thermowell adapter for mounting the temperature sensor to the thermowell.

26. The assembly of claim 25, wherein the thermowell adapter comprises:

a bayonet adapter;

a compression fitting attached to the bayonet adapter, the compression fitting installed in an open end of the thermowell; and a bayonet cap attached to the bayonet adapter;

wherein the temperature sensor passes through the bayonet cap, the bayonet adapter and the compression fitting and into the thermowell.

27. An integrated unit for monitoring and controlling the heating of a process, comprising:

a heater attached to the reservoir, the heater having heating elements and a thermowell that extend into the process;

a control unit for controlling power to the heating elements of the heater;

a temperature sensor mounted within the thermowell of the heater by a thermowell adapter, the temperature sensor capable of measuring a temperature of the process and capable of providing the temperature to the control unit;

a means for coupling the control unit to the heater wherein the coupling means is capable of radially orienting the control unit with respect to the heater.

28. The integrated unit of claim 27, wherein the coupling means comprises:

a means for attaching a first conduit to the heater;

a means for attaching a second conduit to the control unit;

a means for connecting a plurality of power wires from the control unit to the heater;

a means for installing one of the first or second conduits on the other conduit;

a means for attaching the first conduit to the second conduit.

29. A method for monitoring and controlling the heating of a process in a reservoir, the method comprising:

attaching a first conduit to a control unit so that a plurality of power wires from the control unit extend from an opening in the control unit and into the first conduit;

attaching a second conduit to a heater so that a plurality of terminals on the heater extend within the second conduit;

attaching the heater to the reservoir so that a heating element of the heater extends into the process;

connecting the plurality of power wires from the control unit to the plurality of terminals from the heater;

inserting one of the first or second conduits into the other conduit;

orienting the control unit radially with respect to the heater to a selected radial orientation; and maintaining the selected radial orientation by fastening the first conduit to the second conduit.

30. The method of claim 29, wherein fastening the first conduit to the second conduit further comprises inserting a bolt through a locking slot in the first conduit and threading the bolt in a locking hole in the second conduit.

31. The method of claim 29, wherein orienting the control unit radially with respect to the heater to the selected orientation further comprises selectively orienting access to a control panel on the control unit from above, below, or either side of the control unit.

32. The method of claim 29, further comprising the steps of mounting a temperature sensor inside a thermowell in the heater and electrically connecting the temperature sensor to the control unit.

33. The method of claim 32, wherein mounting the temperature sensor inside the thermowell in the heater comprises:

threading a bayonet adapter to a compression fitting;

pressing the compression fitting into the thermowell;

inserting the temperature sensor in a bayonet cap;

installing a portion of the bayonet cap into the bayonet adapter; and locking the bayonet cap to the bayonet adapter.

* * * * *

UNITED STATES PATENT AND TRADEMARK OFFICE

CERTIFICATE OF CORRECTION

PATENT NO. : 6,633,727 B2
DATED : October 14, 2003
INVENTOR(S) : John Henrie et al.

It is certified that error appears in the above-identified patent and that said Letters Patent is hereby corrected as shown below:

Column 4,
Line 15, delete “illustrates” and substitute therefor -- illustrate --.
Lines 16, 18 and 20, delete “.” and substitute therefor -- ; --.
Line 17, delete “illustrates;” and substitute therefor -- illustrate --.

Column 6,
Line 52, delete “is” and substitute therefor -- are --.

Column 8,
Line 48, delete “a” and substitute therefor -- an --.

Column 9,
Line 59, delete “complimentary” and substitute therefor -- complementary --.

Column 12,
Line 35, delete “the”.

Column 14,
Line 27, delete “readily” and substitute therefor -- radially --.
Line 53, delete “a”.

Column 15,
Line 18, delete “readily” and substitute therefor -- radially --.
Line 56, delete “,” and substitute therefor -- ; --.

Signed and Sealed this

Thirteenth Day of July, 2004

JON W. DUDAS
*Acting Director of the United States Patent and Trademark Office*